US008636626B2

(12) United States Patent
Diaz

(10) Patent No.: US 8,636,626 B2
(45) Date of Patent: Jan. 28, 2014

(54) INCLINED SAND TRAINING APPARATUS

(76) Inventor: Diedrick Diaz, Kennedale, TX (US)

( * ) Notice: Subject to any disclaimer, the term of this patent is extended or adjusted under 35 U.S.C. 154(b) by 544 days.

(21) Appl. No.: 12/952,266

(22) Filed: Nov. 23, 2010

(65) Prior Publication Data

US 2012/0129659 A1 May 24, 2012

(51) Int. Cl.
*A63B 17/00* (2006.01)
*A63C 19/04* (2006.01)

(52) U.S. Cl.
USPC ..... 482/51; 434/247; 472/92; 472/94

(58) Field of Classification Search
USPC ..... 472/92, 94; 434/247, 365, 276; 482/35, 482/51, 148
See application file for complete search history.

(56) References Cited

U.S. PATENT DOCUMENTS 3,223,005 A * 12/1965 Carlson ..... 404/47
3,374,491 A * 3/1968 Patin et al. ..... 52/169.7
3,489,685 A * 1/1970 Kublicki ..... 252/62
3,521,580 A * 7/1970 Kimoto ..... 109/49.5
D231,995 S * 7/1974 Mitchko ..... D21/815
3,850,427 A * 11/1974 Schwab ..... 472/126
5,205,791 A * 4/1993 Pledger ..... 472/126
5,527,128 A * 6/1996 Rope et al. ..... 404/35
5,658,226 A * 8/1997 Mentz ..... 482/74
5,954,517 A * 9/1999 Hagenlocher ..... 434/365
6,852,000 B2 * 2/2005 Lee et al. ..... 446/476
7,883,425 B2 * 2/2011 Joseph ..... 472/88
2007/0196173 A1 * 8/2007 Shehan ..... 405/13

FOREIGN PATENT DOCUMENTS

JP 2002364183 A * 12/2002 ..... E04G 23/02
WO WO 9507398 A1 * 3/1995 ..... E04F 15/18

OTHER PUBLICATIONS

Manhattan Beach Sand Dunes website; 2003; http://www.ci.manhattan-beach.ca.us/Index.aspx?page=378.*

* cited by examiner

*Primary Examiner* — Stephen Crow

(57) ABSTRACT

The inclined sand training apparatus includes a front, inclined surface that is sand-filled and lined with sand-filled steps. A walkway traverses across a ridge formed between the front, inclined surface and a rear, inclined surface that is covered in grass. The training apparatus is designed to resemble a sand dune and provide training and workout experiences that includes sand-filled steps, walkway, and a rear, inclined surface covered in grass. The sand-filled steps consist of a concrete riser capped off with a rubber edge that are both backfilled with sand. Lights and other accessories provide a gym-like environment to aid in the training and workout, and further comprise a pool, cycle hut, showers, seating, bathrooms, first aid, and storage.

1 Claim, 5 Drawing Sheets

INCLINED SAND TRAINING APPARATUS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of training systems, more specifically, a sand-filled training layer.

B. Discussion of the Prior Art

As will be discussed immediately below, no prior art discloses a sand-filled dune-like structure wherein a front surface is an inclined sand-filled layer including sand-filled steps on either side; wherein the front surface is used for training purposes and includes lights for use at night; a rear surface includes a grassy incline upon which an end user may use alternatively; wherein a walkway traverses a top ridge between the sand-filled front surface and the grassy incline; wherein each step includes a rubber riser and rubber edge that are back-filled with sand.

The Mentz patent (U.S. Pat. No. 5,658,226) discloses a jogging apparatus comprising a base and a hollow container mounted on the base with a plurality of shock absorbers; wherein the container has an open top defined by a rim, at least one side wall terminating at the rim, an interior space and a bottom, the interior space filled with a predetermined amount of sand. However, the apparatus is not a training apparatus designed to resemble the workout associated with a sand dune, and comprise a grass-covered rear, inclined surface that forms a ridge with the front sand-covered surface.

The Schwab patent (U.S. Pat. No. 3,850,427) discloses a sandbox for recreational purposes. However, the sandbox does not resemble a sand dune that is to be utilized for training and workout purposes.

The Pledger patent (U.S. Pat. No. 5,205,791) discloses a portable sandbox. Again, the sandbox does not resemble a sand dune with steps upon each side for use as a training and workout facility.

The Mentz patent (U.S. Pat. No. 5,658,226) discloses a resilient exercise board, which does not resemble or teach a sand dune that is used for training and workout purposes.

The Hagenlocher patent (U.S. Pat. No. 5,954,517) discloses an interactive sandbox for training. However, the sandbox does not have a front, inclined surface that forms a ridge with a rear, inclined surface covered in grass.

While the above-described devices fulfill their respective and particular objects and requirements, they do not describe a sand-filled dune-like structure wherein a front surface is an inclined sand-filled layer including sand-filled steps on either side; wherein the front surface is used for training purposes and includes lights for use at night; a rear surface includes a grassy incline upon which an end user may use alternatively; wherein a walkway traverses a top ridge between the sand-filled front surface and the grassy incline; wherein each step includes a rubber riser and rubber edge that are back-filled with sand. In this regard, the inclined sand training apparatus departs from the conventional concepts and designs of the prior art.

SUMMARY OF THE INVENTION

The inclined sand training apparatus includes a front, inclined surface that is sand-filled and lined with sand-filled steps. A walkway traverses across a ridge formed between the front, inclined surface and a rear, inclined surface that is covered in grass. The training apparatus is designed to resemble a sand dune and provide training and workout experiences that includes sand-filled steps, walkway, and a rear, inclined surface covered in grass. The sand-filled steps consist of a concrete riser capped off with a rubber edge that are both back-filled with sand. Lights and other accessories provide a gym-like environment to aid in the training and workout, and further comprise a pool, cycle hut, showers, seating, bathrooms, first aid, and storage.

It is an object of the invention to provide a workout facility that provides an end user with a low-impact environment that includes sand.

A further object of the invention is to provide a facility that includes a dune-like structure that includes a sand-filled front, surface that forms a ridge at the top with a rear inclined surface covered in a grass.

A further object of the invention is to provide a plurality of steps on each side leading up to the ridge on the sand-filled side so as to provide a place to run or walk up/down sand-filled steps that is low-impact.

A further object of the invention is to include a walkway that traverses the ridge formed between the front surface and the rear surface.

A further object of the invention is to create a sand dune like structure that can installed permanently or on a temporary basis.

A further object of the invention is to include lights and other amenities that surround the sand dune-like structure.

These together with additional objects, features and advantages of the inclined sand training apparatus will be readily apparent to those of ordinary skill in the art upon reading the following detailed description of presently preferred, but nonetheless illustrative, embodiments of the inclined sand training apparatus when taken in conjunction with the accompanying drawings.

In this respect, before explaining the current embodiments of the inclined sand training apparatus in detail, it is to be understood that the inclined sand training apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the inclined sand training apparatus.

It is therefore important that the claims be regarded as including such equivalent construction insofar as they do not depart from the spirit and scope of the inclined sand training apparatus. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
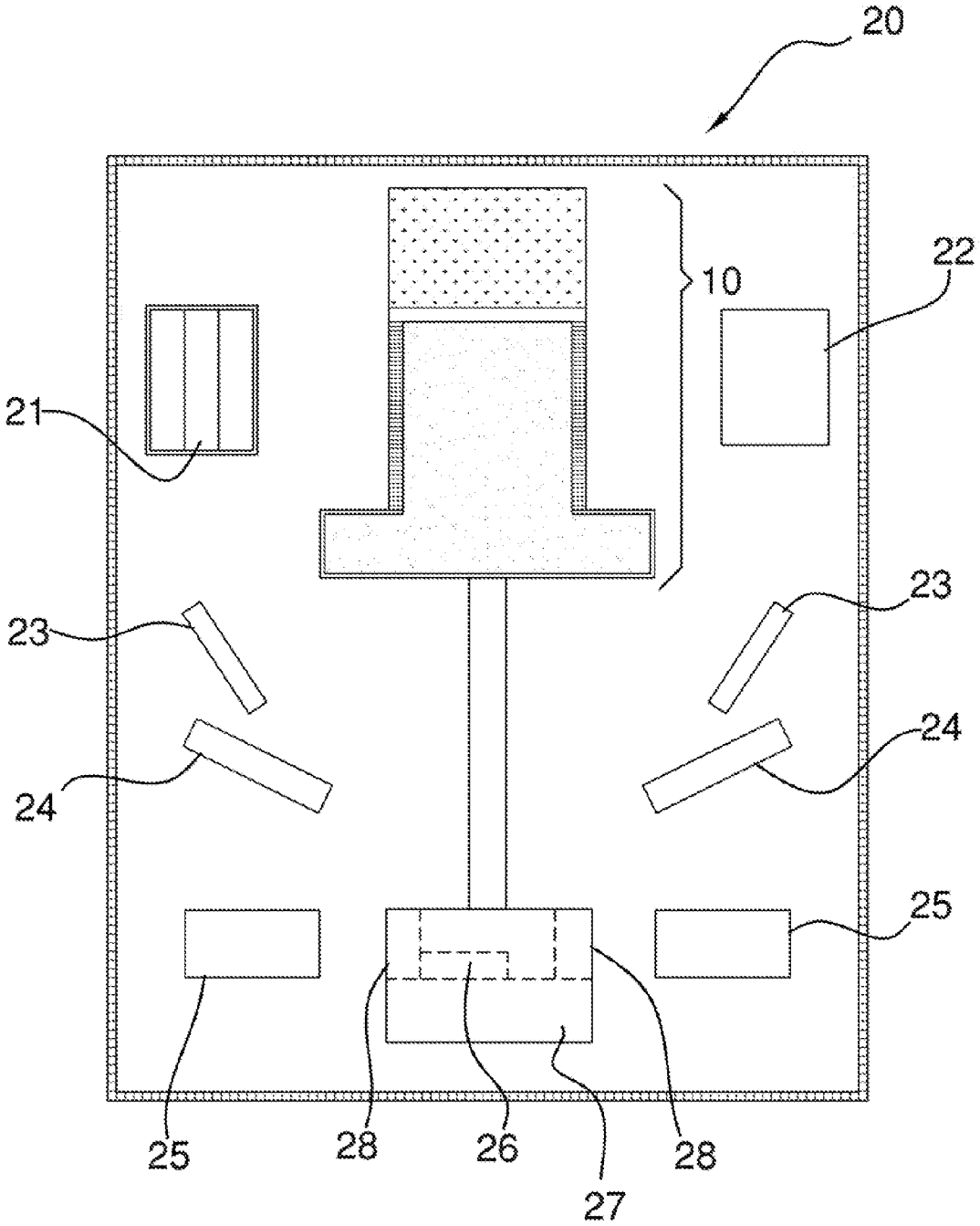
FIG. 1 illustrates a top view of the layout including the inclined sand training apparatus along with the other accessories that may be used when training.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-3A. An inclined sand training apparatus 10 (hereinafter invention) includes a sand dune like structure comprised of a front, inclined surface 11 that forms a ridge 12 with a rear, inclined surface 13.

The front, inclined surface 11 is back-filled with sand 11A to form a low impact environment within which an end user could conduct training and workouts thereon. The front, inclined surface 11 includes legs 11B that extend along a bottom of said front, inclined surface 11. The front, inclined surface 11 is linearly ascending to the ridge 12, which means that the front, inclined surface 11 has a constant rate of inclination.

The front, inclined surface 11 includes a plurality of steps 14 that ascend each side of the front, inclined surface 11 up to the ridge 12. The steps 14 consist of a concrete riser 14A and may include a rubber edge 14B atop said concrete riser 14A. Both the concrete riser 14A and the rubber edge 14B are back-filled with sand 11A. The steps 14 provide an end user with an ability to run or walk up/down said steps in a sand-filled environment that is low impact when compared to the concrete-formed counterpart. The steps 14 meet at a walkway 12A thereon.

The rear, inclined surface 13 is covered in a compacted soil or grass 13A. The rear, inclined surface 13 has a curved descent when compared to the front, inclined surface 11. In other words, the rear, inclined surface 13 does not have a constant rate of inclination.

The ridge 12 is located between the front, inclined surface 11 and the rear, inclined surface 13. The ridge 12 has a flat cross-section, and forms the walkway 12A upon which an end user can walk when so reached.

The front, inclined surface 11 is lined with a handrail 15. The handrail 15 may traverse each side of each row of steps 14 to provide a safety measure against falls by an end user. Accordingly, the handrail 15 traverses each side of the walkway 12A atop the ridge 12.

A plurality of lights 16 surround the invention 10 to enable for nighttime use thereon.

The invention 10 may be a part of a facility 20 that further includes a pool 21, a cycle hut 22, showers 23, seating 24, bathrooms 25, first aid 26, storage 27, and ice makers 28. The facility 20 would in effect resemble a workout facility or gym.

Figure 2:
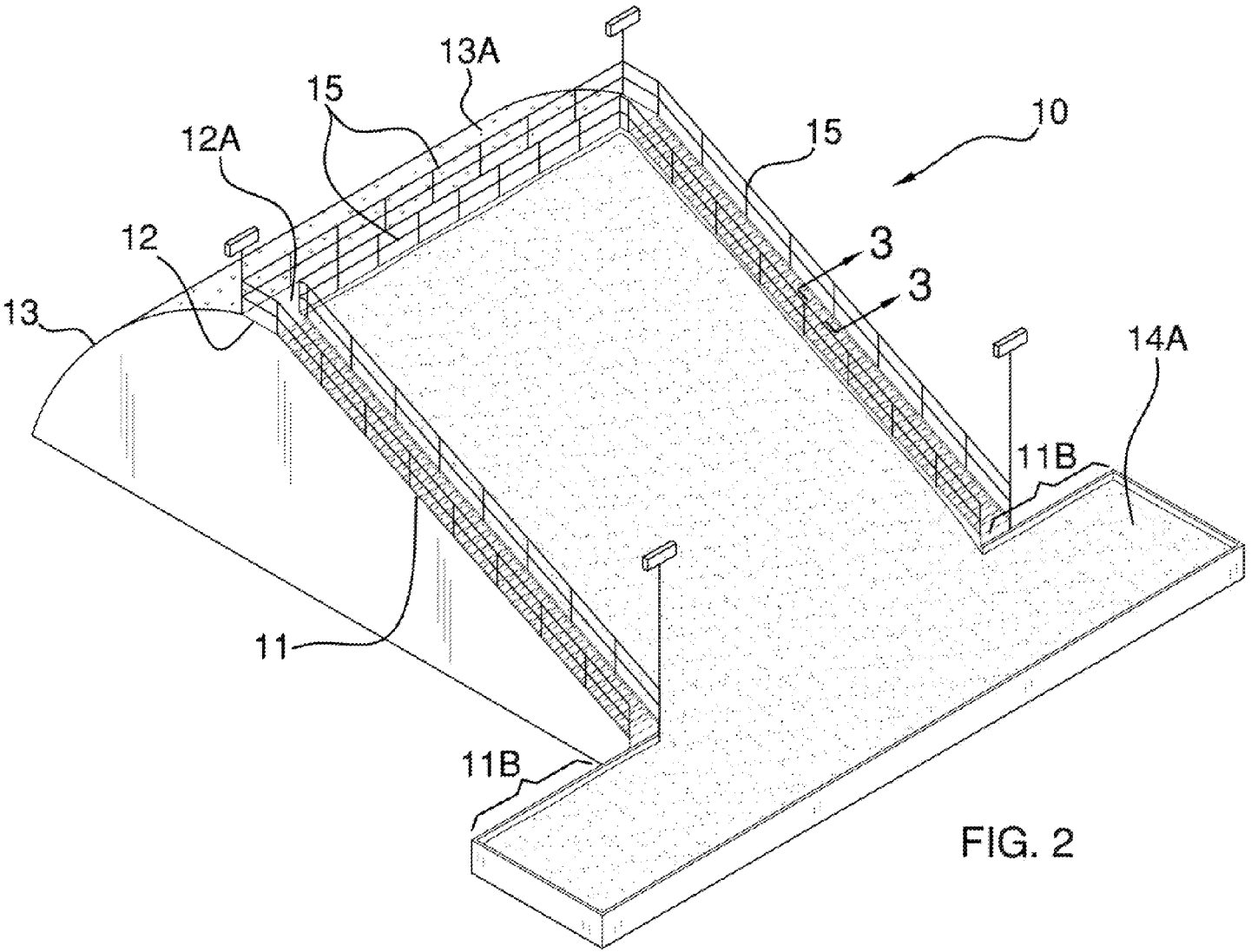
FIG. 2 illustrates a front, isometric view of the inclined sand training apparatus by itself and detailing the front-inclined surface, walkway, sand-filled steps, lights, and rear, inclined surface.
Figure 2A:
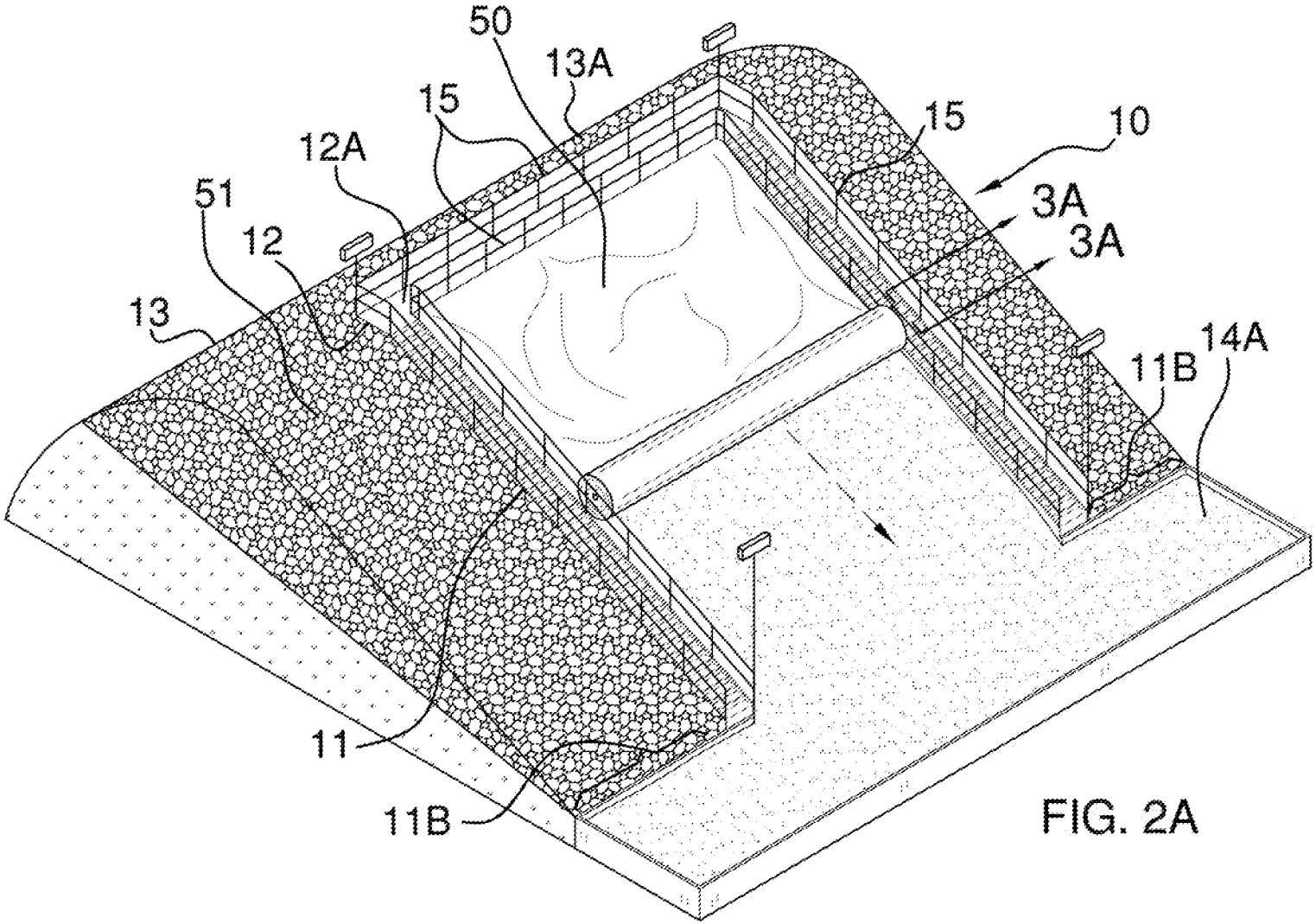
FIG. 2A illustrates a front, isometric view of the inclined sand training apparatus with a protective cover partially rolled down to cover the sand as well as stone work and grass on each side of the front, inclined surface.

Referring to FIG. 2A, the invention 10 may include a protective cover 50 that is capable of rolling up and down to cover the front, inclined surface 11. The inclusion of the protective cover 50 is to protect the sand contained within the front, inclined surface 11 from washing away, and is ideally suited for use to cover the front, inclined surface 11 during periods of rain.

Stone work 51 may extend from a left and right side of the invention 10 in order to provide a visual appeal to the facility that is the invention 10.

Figure 3:
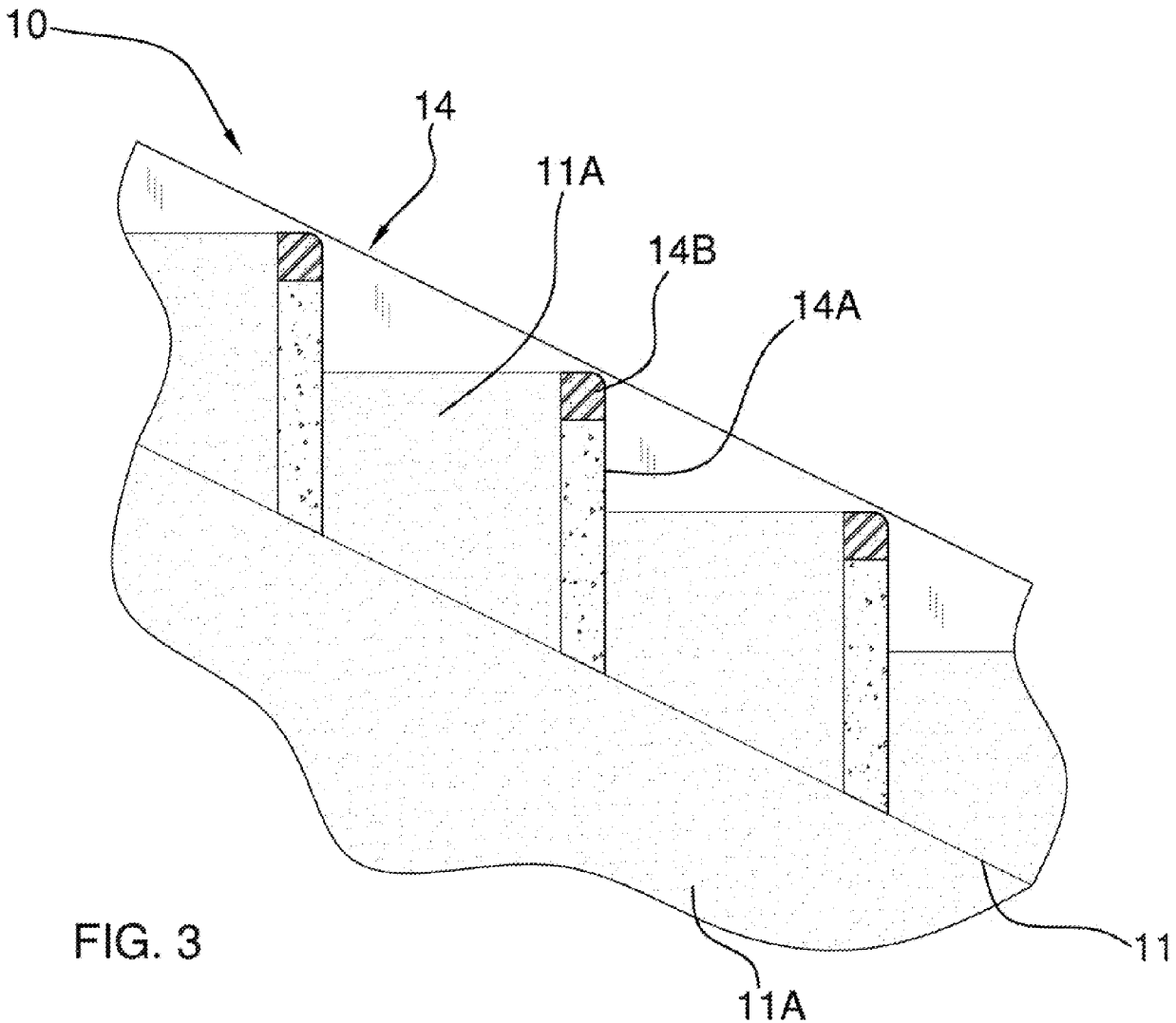
FIG. 3 illustrates a cross-sectional view of the inclined sand training apparatus along line 3-3 in FIG. 2, and detailing the inter-relation of the concrete riser and rubber edge of the sand-filled step.
Figure 3A:
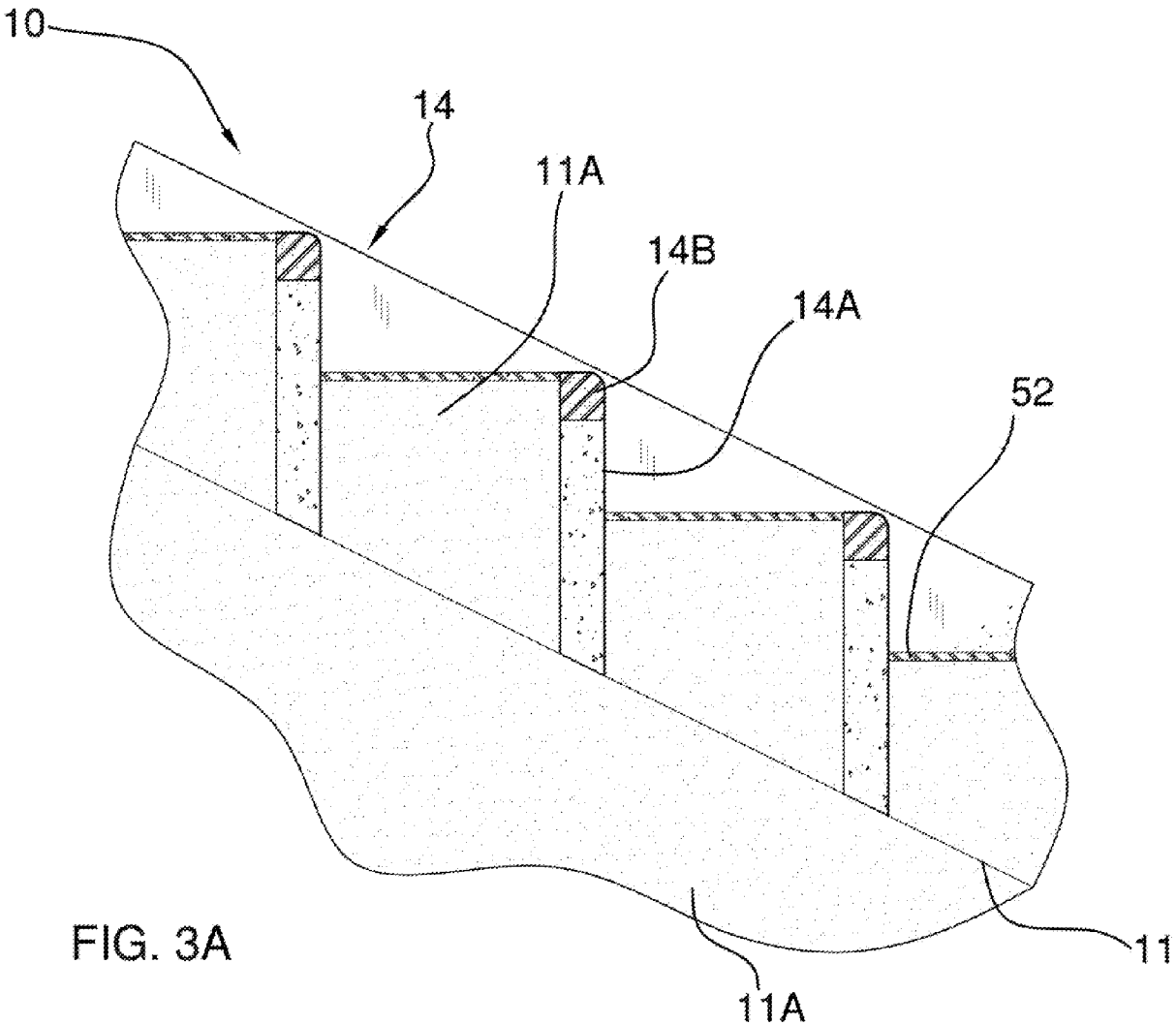
FIG. 3A illustrates a cross-sectional view of the inclined sand training apparatus along line 3-3 in FIG. 2, and detailing a thin rubber sheet lined atop each sand-filled step.

Referring to FIG. 3A, a thin rubber sheet 52 may be installed over each step 14 in order to preserve the sand 11A contained within the step 14 from washing away during periods of rain. Also the inclusion of the thin rubber sheet 52 is also to soften impacts to joints of an end user who is running or walking up and down the steps 11.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A man-made sand dune workout facility comprising:

wherein said sand dune like structure is a part of a facility that further includes showers, seating, bathrooms, first aid, and storage;

a front, inclined surface that is filled with sand to provide a low impact environment to conduct training and exercises thereon;

wherein the front, inclined surface includes steps on each side that lead up to the ridge;

a ridge forms at a top of the front, inclined surface and at a top of a rear, inclined surface covered in grass;

wherein a walkway traverses the ridge formed between the front, inclined surface and the rear, inclined surface;

wherein each step is composed of a concrete riser that is back-filled with sand;

wherein the steps are formed by a concrete riser and a rubber edge that are back-filled with sand;

wherein a handrail is included along the perimeter of the front, inclined surface; and wherein the sand dune like structure is surrounded by a plurality of lights;

wherein a protective cover is included and can roll up and down over the front, inclined surface in order to protect the sand from washing away when not in use;

wherein a thin rubber sheet is installed over each step in order to preserve the sand contained within the step, and also to soften impacts to joints of an end user who is running or walking up and down the steps.

* * * * *